US009845450B2

(12) United States Patent
Constantine et al.

(10) Patent No.: US 9,845,450 B2
(45) Date of Patent: Dec. 19, 2017

(54) SOLID SURFACTANT COMPOSITION

(71) Applicant: COSMETIC WARRIORS LIMITED, Poole, Dorset (GB)

(72) Inventors: Mark Constantine, Poole (GB); Margaret Joan Constantine, Poole (GB); Helen Elizabeth Ambrosen, Wimborne (GB)

(73) Assignee: COSMETIC WARRIORS LIMITED, Poole, Dorset (GB)

( * ) Notice: Subject to any disclaimer, the term of this patent is extended or adjusted under 35 U.S.C. 154(b) by 0 days.

(21) Appl. No.: 14/364,523

(22) PCT Filed: Dec. 5, 2012

(86) PCT No.: PCT/GB2012/053018
§ 371 (c)(1),
(2) Date: Jun. 11, 2014

(87) PCT Pub. No.: WO2013/088120
PCT Pub. Date: Jun. 20, 2013

(65) Prior Publication Data

US 2014/0336095 A1 Nov. 13, 2014

(30) Foreign Application Priority Data

Dec. 12, 2011 (GB) ..... 1121258.6

(51) Int. Cl.

| | |
|---|---|
| ***C11D 17/00*** | (2006.01) |
| ***C11D 1/37*** | (2006.01) |
| ***C11D 3/10*** | (2006.01) |
| ***C11D 3/20*** | (2006.01) |
| *C11D 1/14* | (2006.01) |
| *C11D 1/29* | (2006.01) |

(52) U.S. Cl.
CPC ..... *C11D 17/0052* (2013.01); *C11D 1/37* (2013.01); *C11D 3/10* (2013.01); *C11D 3/2065* (2013.01); *C11D 3/2086* (2013.01); *C11D 17/0008* (2013.01); *C11D 17/0047* (2013.01); *C11D 1/146* (2013.01); *C11D 1/29* (2013.01)

(58) Field of Classification Search
None
See application file for complete search history.

(56) References Cited

U.S. PATENT DOCUMENTS

| | | | | |
|---|---|---|---|---|
| 238,445 | A | 3/1881 | Selby | |
| 4,490,280 | A | 12/1984 | Joshi et al. | |
| 4,493,786 | A | 1/1985 | Joshi | |
| 4,919,838 | A * | 4/1990 | Tibbetts | A61K 8/361 424/70.19 |
| H001680 | H * | 9/1997 | Prieto | C11D 1/146 510/365 |
| 6,248,338 | B1 * | 6/2001 | Muller | A61K 8/732 424/401 |
| 6,362,150 | B1 | 3/2002 | Lunati | |
| 2003/0059483 | A1 * | 3/2003 | Sowle | C11D 3/3955 424/661 |
| 2004/0058855 | A1 | 3/2004 | Schwartz et al. | |
| 2007/0238635 | A1 | 10/2007 | Shah et al. | |
| 2008/0175801 | A1 | 7/2008 | Ramji | |
| 2009/0011973 | A1 | 1/2009 | Besse et al. | |
| 2009/0263340 | A1 * | 10/2009 | Ille-Boehler | A61K 8/368 424/62 |
| 2012/0108487 | A1 * | 5/2012 | Graham | C11D 17/045 510/221 |

FOREIGN PATENT DOCUMENTS

| | | | |
|---|---|---|---|
| GB | 2 346 619 | | 8/2000 |
| JP | H05-508176 | A | 11/1993 |
| JP | 2002-505658 | A | 2/2002 |
| JP | 2008-088235 | A | 4/2008 |
| JP | 3150615 | U | 5/2009 |
| JP | 2010-511053 | A | 4/2010 |
| RU | 2420258 | C2 | 2/2011 |
| WO | 92/01034 | A1 | 1/1992 |
| WO | 97/25404 | A1 | 7/1997 |
| WO | WO 01/68792 | | 9/2001 |
| WO | 2008/073302 | A1 | 6/2008 |
| WO | WO 2010/094975 | | 8/2010 |
| WO | WO 2010/094985 | | 8/2010 |

OTHER PUBLICATIONS

International Search report and Written Opinion for International Application No. PCT/GB2012/083018 mailed Mar. 14, 2013 (11 pages).
Decision to Grant for Russian Patent Application No. 2014128473/04(046069), dated Jan. 27, 2017.

* cited by examiner

*Primary Examiner* — Lorna Douyon
(74) *Attorney, Agent, or Firm* — Merchant & Gould P.C.

(57) ABSTRACT

A surfactant product is in the form of a solid. The surfactant product includes (i) sodium carbonate; (ii) cream of tartar; (iii) glycerine; (iv) sodium lauryl sulphate in an amount of from 3 to 15 wt % based on the weight of the total composition, and (v) sodium laureth sulphate in an amount of from 10 to 25 wt % based on the weight of the total composition.

34 Claims, No Drawings

SOLID SURFACTANT COMPOSITION

This application is a National Stage Application of PCT/GB2012/053018, filed 5 Dec. 2012, which claims benefit of Ser. No. 1121258.6, filed 12 Dec. 2011 in Great Britain and which applications are incorporated herein by reference. To the extent appropriate, a claim of priority is made to each of the above disclosed applications.

FIELD OF THE INVENTION

The present invention relates to a surfactant product, a process for producing said surfactant product, and a method for using the surfactant product.

BACKGROUND TO THE INVENTION

The present invention relates to surfactants particularly those for use in cleaning hard surfaces and the particular for use in cleaning household products, such as kitchen utensils used in the preparation and eating of food.

Liquid products for cleaning hard surfaces have been used for many decades. In the area of cleaning dishes and cutlery, bottles of 'washing up' liquid have been a familiar sight by the sink situated in the kitchen and have performed the necessary task of efficiently cleaning pots, pans, knives, forks and the like, used in the preparation and the eating of a meal. Liquids for cleaning such kitchen equipment need a plastic bottle to keep their form, being liquid. As they contain a large proportion of water, they also need ingredients to preserve the quality of the liquid and keep it free from harmful micro-organisms.

Washing up liquids are required to cleanse large amounts of dirt and grease created from cooking and eating and are quite strong in concentration.

The disadvantages of liquid products for cleaning dishes are that they require solid, plastic packaging, usually bottles with a cap, to keep the product viable. Though some types of bottles may be recyclable, some are not. The caps to secure the liquid in the bottles are generally not recyclable.

Preservatives are also needed to maintain the integrity of such liquids. When discharged from the sink in to the drains and waste water system, preservatives may be harmful to the environment as by their nature they may prevent decay of matter and in eco-systems can therefore be harmful.

It has also been found that the amount of liquid used to cleanse kitchen utensils can easily be excessive. Often the liquid is poured directly on to the utensils, leading to far more being used than is necessary. When added to running water in excessive amounts, the use of such liquids may also lead to a mass of foam, which is difficult to rinse away, leading to a residue being left on the utensils.

Washing up liquids can also easily be used and frequently are, for hand washing, which they are not formulated to do. Efforts have been made by manufacturers to make liquids milder but pouring directly on to the skin is not desirable. Particularly when an excessive amount is used, hands can be left dry or irritated.

The present invention seeks to provide surfactant products which do not require packaging, which allow for the cleaning of hard surfaces such as kitchen utensils, and which are not unduly harsh to the skin of the user.

SUMMARY OF THE INVENTION

In a first aspect, there is provided a surfactant product in the form of a solid comprising (i) sodium carbonate; (ii) cream of tartar; (iii) glycerine; (iv) sodium lauryl sulphate in an amount of from 3 to 15 wt % based on the weight of the total composition, and (v) sodium laureth sulphate in an amount of from 10 to 25 wt % based on the weight of the total composition.

In a second aspect, there is provided a process for the production of a surfactant product as defined herein comprising the steps of: a) preparing a composition comprising (i) sodium carbonate; (ii) cream of tartar; (iii) glycerine; (iv) sodium lauryl sulphate in an amount of from 3 to 15 wt % based on the weight of the total composition, and (v) sodium laureth sulphate in an amount of from 10 to 25 wt % based on the weight of the total composition; b) allowing the composition of step a) to solidify.

In a third aspect, there is provided a method for cleaning a hard surface, the method comprising (a) dissolving in water an effective amount of a surfactant product a surfactant product in the form of a solid comprising (i) sodium carbonate; (ii) cream of tartar; (iii) glycerine; (iv) sodium lauryl sulphate in an amount of from 3 to 15 wt % based on the weight of the total composition, and (v) sodium laureth sulphate in an amount of from 10 to 25 wt % based on the weight of the total composition, to provide an aqueous cleaning solution; (b) contacting the hard surface with the aqueous cleaning solution.

For ease of reference, these and further aspects of the present invention are now discussed under appropriate section headings. However, the teachings under each section are not necessarily limited to each particular section.

Advantages

We have found that in contrast to the prior art products the present invention addresses the environmental disadvantages of hard surface cleaners, such as conventional liquid dish and utensil cleansing liquids. This invention provides a solid form of the product, which does not require external packaging to maintain the shape of the product. Therefore there is no need for conventional plastic bottles or caps. The present composition does not contain high levels of water and so does not need preservative ingredients to maintain the quality of the product. Therefore the disposal of wastewater containing preservative ingredients is avoided and the present product has a lower impact on the environment.

As the present composition is provided in a solid form, the shape can be agitated in the water dissolving an effective though minimal amount to efficiently clean utensils without direct un-diluted contact on the hands. The solution produced in the water, will not dry the hands as it is not too concentrated. This is because the product has not been poured directly on to the skin and neither has an excessive amount been dispensed in to the water in the sink.

As discussed herein, the present surfactant product contains sodium lauryl sulphate in an amount of from 3 to 15 wt % and sodium laureth sulphate in an amount of from 10 to 25 wt %, each based on the weight of the total composition. We have found that through this choice of surfactant ingredients and through this choice of amounts of these specific surfactant ingredients, hard surfaces such as kitchen utensils may be cleansed effectively. Yet further through the choice and balance of these two surfactant ingredients, the necessary cleansing effect is achieved without the solution being too harsh on the skin of a user. The addition of glycerine in the composition further helps protect the skin of the user in contact with the solution of the present product The presence of glycerine is further advantageous because it assists the manufacturing process. The addition of glycerine slows the speed at which the mixture sets and may prevent the mixture from setting to a solid form too quickly.

In the absence of glycerine it may be difficult to press the product into moulds before hardening. The glycerine content keeps the mixture softer for longer.

DETAILED DESCRIPTION

Composition

As discussed herein, in one aspect of the present invention, there is provided a surfactant product in the form of a solid comprising (i) sodium carbonate; (ii) cream of tartar; (iii) glycerine; (iv) sodium lauryl sulphate in an amount of from 3 to 15 wt % based on the weight of the total composition, and (v) sodium laureth sulphate in an amount of from 10 to 25 wt % based on the weight of the total composition.

Surfactant products of the present invention are compositions which can substantially sustain their physical shape when unsupported by external means, e.g. packaging etc. Thus, they are considered to be solid, solid like, in solid form or in solid-like form at room temperature.

By solid-like, it is understood that some materials are considered on a day to day basis to be solid, yet over an extremely long period of time, may alter in shape, e.g. amorphous materials such as glass etc. However, they are considered to be solid-like as, for the purpose they fulfil, they are solid.

As mentioned above, due to the solid form of the compositions of the present invention, external packaging is not required to maintain the shape of the composition.

Surfactant

The surfactant product of the present invention comprises sodium lauryl sulphate in an amount of from 3 to 15 wt % and sodium laureth sulphate in an amount of from 10 to 25 wt %, each based on the weight of the total composition The present composition may contain in addition to the specified surfactants, one or more further surfactants. These further surfactants may be selected from cocamide diethanolamine, lauryl betaine, N-lauryl-sarcosine and mixtures thereof.

In one preferred aspect, the present composition further comprising (vi) a foaming surfactant. It will be understood by one skilled in the art that a foaming surfactant is a surfactant whose primary purpose is to provide a foam rather than to cleanse the hard surface. It will be understood therefore that the foaming surfactant is other than sodium lauryl sulphate and sodium laureth sulphate.

Preferably the foaming surfactant is present in an amount of from 3 to 10 wt % based on the weight of the total composition, such as in an amount of from 3 to 9 wt % based on the weight of the total composition, such as in an amount of from 3 to 8 wt % based on the weight of the total composition, such as in an amount of from 3 to 7 wt % based on the weight of the total composition, such as in an amount of from 4 to 6 wt % based on the weight of the total composition, such as in an amount of approximately 5 wt % based on the weight of the total composition.

The foaming surfactant may be selected from any suitable surfactants. In one preferred aspect the foaming surfactant is selected from the group consisting of lauryl betaine, cocamide diethanolamine, N-lauryl-sarcosine and mixtures thereof. In one preferred aspect the foaming surfactant is lauryl betaine The surfactant product of the present invention comprises sodium lauryl sulphate in an amount of from 3 to 15 wt % based on the weight of the total composition. In one preferred aspect, the surfactant product of the present invention comprises sodium lauryl sulphate in an amount of from 3 to 12 wt % based on the weight of the total composition, such as in an amount of from 3 to 10 wt % based on the weight of the total composition, such as in an amount of from 3 to 8 wt % based on the weight of the total composition, such as in an amount of from 3 to 6 wt % based on the weight of the total composition, such as in an amount of from 3 to 5 wt % based on the weight of the total composition, such as in an amount of approximately 4wt % based on the weight of the total composition.

The surfactant product of the present invention comprises sodium laureth sulphate in an amount of from 10 to 25 wt % based on the weight of the total composition. In one preferred aspect, the surfactant product of the present invention comprises sodium laureth sulphate in an amount of from 10 to 20 wt % based on the weight of the total composition, such as in an amount of from 12 to 20 wt % based on the weight of the total composition, such as in an amount of from 13 to 19 wt % based on the weight of the total composition, such as in an amount of from 14 to 18 wt % based on the weight of the total composition, such as in an amount of from 15 to 17 wt % based on the weight of the total composition, such as in an amount of approximately 16wt % based on the weight of the total composition.

Sodium Carbonate

The surfactant product of the present invention also comprises sodium carbonate. In one embodiment, sodium carbonate is present in an amount of from 20 to 45 wt % based on the weight of the total composition.

In one embodiment, sodium carbonate is present in an amount of from 20 to 37 wt % based on the weight of the total composition.

In one embodiment, sodium carbonate is present in an amount of from 25 to 45 wt % based on the weight of the total composition.

In one embodiment, sodium carbonate is present in an amount of from 25 to 37 wt % based on the weight of the total composition.

In one embodiment, sodium carbonate is present in an amount of from 30 to 45 wt % based on the weight of the total composition.

In one embodiment, sodium carbonate is present in an amount of from 35 to 45 wt % based on the weight of the total composition.

In one embodiment, sodium carbonate is present in an amount of from 30 to 37 wt % based on the weight of the total composition.

In one embodiment, sodium carbonate is present in an amount of from 33 to 45 wt % based on the weight of the total composition.

In one embodiment, sodium carbonate is present in an amount of from 37 to 45 wt % based on the weight of the total composition.

In one embodiment, sodium carbonate is present in an amount of from 39 to 45 wt % based on the weight of the total composition.

In one embodiment, sodium carbonate is present in an amount of from 41 to 43 wt % based on the weight of the total composition.

In one embodiment, sodium carbonate is present in an amount of approximately 42% by weight of the total composition.

Sodium carbonate ($Na_2CO_3$) is a sodium salt of carbonic acid. It is also known as washing soda or soda ash. It has many industrial, food and cosmetic uses.

Cream of Tartar

The surfactant product of the present invention also comprises cream of tartar. Cream of tartar is also known as potassium bitartrate or potassium hydrogen tartrate. It is the mono-potassium salt of 2,3-dihydroxybutanedioic acid. Thus, the cream of tartar used in the surfactant product of the present invention encompasses any product which is considered to be cream of tartar by virtue of it substantially comprising potassium hydrogen tartrate.

In one embodiment, the cream of tartar of the surfactant product is potassium hydrogen tartrate.

In one embodiment, the cream of tartar is present in an amount of from 5 to 25 wt % based on the weight of the total composition.

In one embodiment, the cream of tartar is present in an amount of from 5 to 21 wt % based on the weight of the total composition.

In one embodiment, the cream of tartar is present in an amount of from 10 to 25 wt % based on the weight of the total composition.

In one embodiment, the cream of tartar is present in an amount of from 15 to 25 wt % based on the weight of the total composition.

In one embodiment, the cream of tartar is present in an amount of from 10 to 21 wt % based on the weight of the total composition.

In one embodiment, the cream of tartar is present in an amount of from 15 to 21 wt % based on the weight of the total composition.

In one embodiment, the cream of tartar is present in an amount of from 17 to 25 wt % based on the weight of the total composition.

In one embodiment, the cream of tartar is present in an amount of from 17 to 21 wt % based on the weight of the total composition.

In one embodiment, the cream of tartar is present in an amount of from 19 to 25 wt % based on the weight of the total composition.

In one embodiment, the cream of tartar is present in an amount of from 19 to 23 wt % based on the weight of the total composition.

In one embodiment, the cream of tartar is present in an amount of from 19 to 21 wt % based on the weight of the total composition.

In one embodiment, the cream of tartar is present in an amount of from 20 to 22 wt % based on the weight of the total composition.

In one embodiment, the cream of tartar is present in an amount of approximately 21% by weight of the total composition.

Glycerine

The surfactant product of the present invention also comprises glycerine. Glycerine is also known as glycerin, glycerol and propane-1,2,3-triol.

As discussed herein, the addition of glycerine in the composition helps protect the skin of the user in contact with the solution of the present product furthermore glycerine assists in the manufacturing process of the product and in particular it lowers the temperature of the chemical reaction resulting from the combination of sodium carbonate and the cream of tartar. Furthermore the addition of glycerine assists in the release of a solid product of the invention from a mould when the composition has hardened.

The glycerine may be present in any suitable amount to achieve the desired aims of the present invention. In one aspect glycerine is present in an amount of no greater than 15 wt % based on the weight of the total composition, such as in an amount of no greater than 12 wt % based on the weight of the total composition, such as in an amount of no greater than 10 wt % based on the weight of the total composition, such as in an amount of no greater than 8 wt % based on the weight of the total composition.

In one aspect glycerine is present in an amount of no less than 1 wt % based on the weight of the total composition, such as in an amount of no less than 2 wt % based on the weight of the total composition, such as in an amount of no less than 4 wt % based on the weight of the total composition, such as in an amount of no less than 5 wt % based on the weight of the total composition, such as in an amount of no less than 7 wt % based on the weight of the total composition, such as in an amount of no less than 8 wt % based on the weight of the total composition.

In one aspect glycerine is present in an amount of from 5 to 15 wt % based on the weight of the total composition, such as in an amount of from 5 to 10 wt % based on the weight of the total composition, such as in an amount of from 7 to 9 wt % based on the weight of the total composition.

Preferred Compositions & Additional Components

The surfactant product of the present invention may also comprise one or more acceptable additives. The person skilled in the art is aware of a range of acceptable additives which are suitable for incorporation into such compositions. Fruit and herb extracts and juices, vegetable oils and essential oils are all compatible with the composition. Colours, both naturally derived and synthetic can be used to colour the surfactant product.

In one embodiment, the acceptable additives are selected from the group consisting of oils, fragrances, colourings, and mixtures thereof.

In one embodiment, the acceptable additives are present in amount of no greater than 6% by weight of the total composition. In one embodiment, the acceptable additives are present in amount of no greater than 5% by weight of the total composition. In one embodiment, the acceptable additives are present in amount of no greater than 4% by weight of the total composition. In one embodiment, the acceptable additives are present in amount of from about 0.01% to about 5% by weight of the total composition. In one embodiment, the acceptable additives are present in amount of from about 0.01% to about 3% by weight of the total composition.

The ingredients in the present invention do not require preservatives, solublisers or alcohols, such as ethanol. The use of preservatives can increase the potential to irritate the skin. The use of alcohols can cause the skin to become dry. Equally, fragrances do not need to be solublised and therefore solublisers can be avoided.

In a preferred embodiment, the surfactant product is a dish washing detergent.

In a preferred embodiment, the surfactant product comprises (i) sodium carbonate in an amount of from 20 to 37 wt % based on the weight of the total composition;

(ii) cream of tartar in an amount of from 5 to 21 wt % based on the weight of the total composition;

(iii) glycerine in an amount of no greater than 15 wt % based on the weight of the total composition (iv) sodium lauryl sulphate in an amount of from 3 to 15 wt % based on the weight of the total composition, and (v) sodium laureth sulphate in an amount of from 10 to 25 wt % based on the weight of the total composition.

The above ranges provide preferred amounts of each of the components. Each of these ranges may be taken alone or combined with one or more other component ranges to provide a preferred aspect of the invention.

Process

In another aspect, there is provided process for the production of a surfactant product comprising the steps of: a) preparing a composition comprising (i) sodium carbonate; (ii) cream of tartar; (iii) glycerine; (iv) sodium lauryl sulphate in an amount of from 3 to 15 wt % based on the weight of the total composition, and (v) sodium laureth sulphate in an amount of from 10 to 25 wt % based on the weight of the total composition; b) allowing the composition of step a) to solidify.

The shape of the surfactant products of the present invention is not limited. It may be that the surfactant products are provided with a shape which would be aesthetically pleasing and/or which aids in the use of the product. For example, it may be that the surfactant product is produced in such a manner so that it solidifies in a shape which is ergonomically acceptable to the user.

Therefore, in one embodiment of the process of the present invention, the mixture of step a) is caused to solidify in a predetermined shape.

In one embodiment of the process of the present invention, the mixture of step a) is pressed into a mould, allowed to solidify, and then turned out to produce the surfactant product.

As described herein, the surfactant product may further comprise one or more acceptable additives. In one embodiment, the process further comprises the step of combining with the mixture of step a) one or more acceptable additives as defined above.

Method

In one aspect of the present invention, there is provided a method for cleaning a hard surface, the method comprising (i) dissolving in water an effective amount of a surfactant product as defined herein to provide an aqueous cleaning solution;

(ii) contacting the hard surface with the aqueous cleaning solution.

Further Broad Aspects

In further broad aspects the present invention provides:

Aspect 1. A surfactant product in the form of a solid comprising (i) a surfactant in an amount of from 26 to 40 wt % based on the weight of the total composition, (ii) sodium carbonate in an amount of from 20 to 37 wt % based on the weight of the total composition;

(iii) cream of tartar in an amount of from 5 to 21 wt % based on the weight of the total composition;

(iv) glycerine in an amount of no greater than 15 wt % based on the weight of the total composition Aspect 2. A surfactant product according to aspect 1, comprising a surfactant in an amount of from 30 to 40 wt % based on the weight of the total composition.

Aspect 3. A surfactant product according to aspect 2, comprising a surfactant in an amount of from 33 to 37 wt % based on the weight of the total composition.

Aspect 4. A surfactant product according to aspect 3, comprising a surfactant in an amount of from 34 to 36 wt % based on the weight of the total composition.

Aspect 5. A surfactant product according to any one of aspects 1 to 4, wherein the surfactant is selected from the group consisting of sodium laureth sulfate, cocamide diethanolamine, lauryl betaine, and mixtures thereof.

Aspect 6. A surfactant product according to any one of aspects 1 to 5, comprising sodium carbonate in an amount of from 25 to 37 wt % based on the weight of the total composition.

Aspect 7. A surfactant product according to aspect 6, comprising sodium carbonate in an amount of from 30 to 37 wt % based on the weight of the total composition.

Aspect 8. A surfactant product according to aspect 7, comprising sodium carbonate in an amount of from 33 to 37 wt % based on the weight of the total composition.

Aspect 9. A surfactant product according to any one of aspects 1 to 8, comprising cream of tartar in an amount of from 10 to 21 wt % based on the weight of the total composition.

Aspect 10. A surfactant product according to aspect 9, comprising cream of tartar in an amount of from 15 to 21 wt % based on the weight of the total composition.

Aspect 11. A surfactant product according to aspect 10, comprising cream of tartar in an amount of from 16 to 19 wt % based on the weight of the total composition.

Aspect 12. A surfactant product according to any one of aspects 1 to 11, comprising glycerine in an amount of from 5 to 15 wt % based on the weight of the total composition.

Aspect 13. A surfactant product according to aspect 12, comprising glycerine in an amount of from 5 to 10 wt % based on the weight of the total composition.

Aspect 14. A surfactant product according to aspect 13, comprising glycerine in an amount of from 7 to 9 wt % based on the weight of the total composition.

Aspect 15. A surfactant product according to any one of aspects 1 to 14, further comprising one or more additives selected from the group consisting of oils, fragrances, colourings and mixtures thereof.

Aspect 16. A surfactant product according to aspect 15, further comprising fragrance and colouring.

Aspect 17. A surfactant product according to aspect 15 or 16, further comprising one or more additives in an amount of from 0.2% to 5% by weight of the total composition.

Aspect 18. A surfactant product according to any one of aspects 1 to 17, wherein the surfactant product is a dish washing detergent.

Aspect 19. A process for the production of a surfactant product as defined in aspects 1 to 18 comprising the steps of: a) preparing a composition comprising (i) a surfactant in an amount of from 26 to 40 wt % based on the weight of the total composition, (ii) sodium carbonate in an amount of from 20 to 37 wt % based on the weight of the total composition; (iii) cream of tartar in an amount of from 5 to 21 wt % based on the weight of the total composition; (iv) glycerine in an amount of no greater than 15 wt % based on the weight of the total composition b) allowing the composition of step a) to solidify.

Aspect 20. A process according to aspect 21, wherein the mixture of step a) is caused to solidify in a predetermined shape.

Aspect 21. A process according to aspect 19 or aspect 20, further comprising the step of combining with the mixture of step a), one or more additives as defined in aspect 15.

Aspect 22. A product obtainable by the process of any one of aspects 19 to 21.

Aspect 23. A product prepared by the process of any one of aspects 19 to 21.

Aspect 24. A method for cleaning a hard surface, the method comprising (i) dissolving in water an effective amount of a surfactant product as defined in any one of aspects 1 to 18 to provide an aqueous cleaning solution; (ii) contacting the hard surface with the aqueous cleaning solution.

EXAMPLES

The invention will now be described with reference to the following non-limiting example.

A surfactant product having the following composition was prepared.

The Formulation for the composition will be as follows;

| | |
|---|---|
| Colour | 0.5% |
| Fragrance | 3.5% |
| Sodium Lauryl Sulphate | 4% |
| Sodium Laureth Sulphate | 16% |
| Lauryl Betaine | 5% |
| Glycerine | 8% |
| Sodium Carbonate | 42% |
| Cream Of Tartar | 21% |
| TOTAL | 100% |

The process of manufacture requires that the colour and fragrance should be blended with part of the primary surfactants (namely the Sodium Lauryl Sulphate and Sodium Laureth Sulphate). This solublises these ingredients and enables their efficient dispersal through the powders in the composition, which are sodium carbonate and cream of tartar.

The remainder of the primary surfactant(s) (Sodium Lauryl Sulphate and Sodium Laureth Sulphate) are blended with the glycerine. The powders of sodium carbonate and cream of tartar are mixed. The fragrance, colour and primary surfactants are added to the powders followed by the remainder of the primary surfactant and the glycerine. The foaming surfactant (Lauryl Betaine) is added and the composition is mixed to a smooth paste. An amount is pressed into a suitably shaped mould and allowed to harden, typically between twelve and twenty four hours. The shape is then easily released from the mould and is ready for use.

The solid product was dissolved in part in a sink of warm water by holding the product under running tap water or the solid product can be moved through the water to generate foam and dissolve surfactants . A solution of surfactant product was provided. A mixture of crockery and cutlery which had been used for a domestic meal were washed in the surfactant solution. From visual inspection it could be seen that the services were clean and free from grease.

Various modifications and variations of the present invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry, biology or related fields are intended to be within the scope of the following claims.

The invention claimed is:

1. A surfactant product in the form of a solid comprising:
(i) sodium carbonate;
(ii) cream of tartar;
(iii) glycerine in an amount of from 5 to 15 wt % based on the weight of the total composition;
(iv) sodium lauryl sulphate in an amount of from 3 to 15 wt % based on the weight of the total composition, and
(v) sodium laureth sulphate in an amount of from 16 to 25 wt % based on the weight of the total composition.

2. A surfactant product according to claim 1, comprising sodium carbonate in an amount of from 20 to 45 wt % based on the weight of the total composition.

3. A surfactant product according to claim 1, comprising sodium carbonate in an amount of from 20 to 37 wt % based on the weight of the total composition.

4. A surfactant product according to claim 1, comprising sodium carbonate in an amount of from 25 to 45 wt % based on the weight of the total composition.

5. A surfactant product according to claim 1, comprising sodium carbonate in an amount of from 30 to 45 wt % based on the weight of the total composition.

6. A surfactant product according to claim 1, comprising sodium carbonate in an amount of from 35 to 45 wt % based on the weight of the total composition.

7. A surfactant product according to claim 1, comprising sodium carbonate in an amount of from 39 to 45 wt % based on the weight of the total composition.

8. A surfactant product according to claim 1, comprising sodium carbonate in an amount of from 41 to 43 wt % based on the weight of the total composition.

9. A surfactant product according to claim 1, comprising cream of tartar in an amount of from 5 to 25 wt % based on the weight of the total composition.

10. A surfactant product according to claim 1, comprising cream of tartar in an amount of from 5 to 21 wt % based on the weight of the total composition.

11. A surfactant product according to claim 1, comprising cream of tartar in an amount of from 10 to 25 wt % based on the weight of the total composition.

12. A surfactant product according to claim 1, comprising cream of tartar in an amount of from 15 to 25 wt % based on the weight of the total composition.

13. A surfactant product according to claim 1, comprising cream of tartar in an amount of from 10 to 21 wt % based on the weight of the total composition.

14. A surfactant product according to claim 1, comprising cream of tartar in an amount of from 15 to 21 wt % based on the weight of the total composition.

15. A surfactant product according to claim 1, comprising cream of tartar in an amount of from 19 to 23 wt % based on the weight of the total composition.

16. A surfactant product according to claim 1, comprising glycerine in an amount of from 5 to 10 wt % based on the weight of the total composition.

17. A surfactant product according to claim 1, comprising glycerine in an amount of from 7 to 9 wt % based on the weight of the total composition.

18. A surfactant product according to claim 1, comprising sodium lauryl sulphate in an amount of from 3 to 12 wt % based on the weight of the total composition.

19. A surfactant product according to claim 1, comprising sodium lauryl sulphate in an amount of from 3 to 5 wt % based on the weight of the total composition.

20. A surfactant product according to claim 1, comprising sodium laureth sulphate in an amount of from 16 to 20 wt % based on the weight of the total composition.

21. A surfactant product according to claim 1, comprising sodium laureth sulphate in an amount of from 16 to 17 wt % based on the weight of the total composition.

22. A surfactant product according to claim 1, further comprising (vi) a foaming surfactant, wherein the foaming surfactant is other than sodium lauryl sulphate and sodium laureth sulphate.

23. A surfactant product according to claim 22, wherein the foaming surfactant is present in an amount of from 3 to 10 wt % based on the weight of the total composition.

24. A surfactant product according to claim 22, wherein the foaming surfactant is present in an amount of from 3 to 7 wt % based on the weight of the total composition.

25. A surfactant product according to claim 22, wherein the foaming surfactant is selected from the group consisting of lauryl betaine, cocamide diethanolamine, N-lauryl-sarcosine and mixtures thereof.

26. A surfactant product according to claim 1, comprising
(i) sodium carbonate in an amount of from 20 to 37 wt % based on the weight of the total composition;
(ii) cream of tartar in an amount of from 5 to 21 wt % based on the weight of the total composition;
(iii) glycerine in an amount from 5 to 15 wt % based on the weight of the total composition
(iv) sodium lauryl sulphate in an amount of from 3 to 15 wt % based on the weight of the total composition, and
(v) sodium laureth sulphate in an amount of from 16 to 25 wt % based on the weight of the total composition.

27. A surfactant product according to claim 1, further comprising one or more additives selected from the group consisting of oils, fragrances, colourings and mixtures thereof.

28. A surfactant product according to claim 27, wherein the one or more additives is a mixture of fragrance and colouring.

29. A surfactant product according to claim 27, further comprising one or more additives in an amount of from 0.2% to 5% by weight of the total composition.

30. A surfactant product according to claim 1, wherein the surfactant product is a dish washing detergent.

31. A surfactant product in the form of a solid comprising:
(i) sodium carbonate;
(ii) cream of tartar;
(iii) glycerine in an amount of from 5 to 15 wt % based on the weight of the total composition;
(iv) sodium lauryl sulphate in an amount of from 3 to 15 wt % based on the weight of the total composition;
(v) sodium laureth sulphate in an amount of from 15 to 25 wt % based on the weight of the total composition; and
(vi) a foaming surfactant in an amount of from 3 to 10 wt % based on the weight of the total composition, wherein the foaming surfactant is other than sodium lauryl sulphate and sodium laureth sulphate, and wherein the foaming surfactant is selected from the group consisting of lauryl betaine, cocamide diethanolamide, N-lauryl-sarcosine and mixtures thereof.

32. A process for the production of a surfactant product as defined in claim 1, comprising the steps of:
a) preparing a composition comprising:
(i) sodium carbonate;
(ii) cream of tartar;
(iii) glycerine;
(iv) sodium lauryl sulphate; and
(v) sodium laureth sulphate;
b) allowing the composition of step a) to solidify.

33. A process according to claim 32, further comprising the step of combining with the mixture of step a), one or more additives selected from the group consisting of oils, fragrances, colourings and mixtures thereof.

34. A method for cleaning a hard surface, the method comprising:
(i) dissolving in water an effective amount of a surfactant product as defined in claim 1 to provide an aqueous cleaning solution;
(ii) contacting the hard surface with the aqueous cleaning solution.

* * * * *